US007893802B2

(12) United States Patent
Förtsch et al.

(10) Patent No.: US 7,893,802 B2
(45) Date of Patent: Feb. 22, 2011

(54) POSITION SWITCH

(75) Inventors: Silvio Förtsch, Kümmersbruck (DE); Bernhard Hiltl, Kümmersbruck (DE); Werner Puri, Nürnberg (DE); Joachim Seidl, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 473 days.

(21) Appl. No.: 11/822,134

(22) Filed: Jul. 2, 2007

(65) Prior Publication Data

US 2008/0012671 A1 Jan. 17, 2008

(30) Foreign Application Priority Data

Jul. 3, 2006 (EP) ..... 06013744

(51) Int. Cl.
*H01H 27/00* (2006.01)
*H01F 7/00* (2006.01)

(52) U.S. Cl. ..... 335/229; 335/234; 200/43.01; 200/43.04; 200/43.07; 200/318

(58) Field of Classification Search ..... 335/229–234; 200/43.01, 43.04, 43.07, 318, 334; 70/277–283.1, 70/432–441; 340/644
See application file for complete search history.

(56) References Cited

U.S. PATENT DOCUMENTS

| | | | | |
|---|---|---|---|---|
| 3,984,795 | A | 10/1976 | Gaskill | |
| 4,746,885 | A * | 5/1988 | Ogata et al. | 335/160 |
| 5,959,519 | A * | 9/1999 | Gobel et al. | 335/179 |

FOREIGN PATENT DOCUMENTS

| | | |
|---|---|---|
| EP | 0 977 228 A2 | 2/2000 |
| GB | 2 142 780 | 1/1985 |

* cited by examiner

*Primary Examiner*—Ramon M Barrera
(74) *Attorney, Agent, or Firm*—Harness, Dickey & Pierce, P.L.C.

(57) ABSTRACT

A position switch is disclosed with a device to generate a magnetic force, with at least a first coil and at least one armature, it being possible to magnetize and move the armature via the first coil. How the magnetic force, particularly at the start of movement of the movable components of the device, can be increased to reduce the necessary power consumption of the first coil, is a focus of at least one embodiment. For this purpose, at least one embodiment of the device to generate a magnetic force includes at least one device to premagnetize the armature. The result includes a series of advantages, e.g. a smaller design, lower power consumption and possible use with multiple different switching units with different counterforces.

22 Claims, 4 Drawing Sheets

POSITION SWITCH

PRIORITY STATEMENT

The present application hereby claims priority under 35 U.S.C. §119 on European patent application number EP06013744 filed Jul. 3, 2006, the entire contents of which is hereby incorporated herein by reference.

FIELD

Embodiments of the invention generally relate to a position switch with at least a first coil and at least one armature, it being possible to magnetize and move the armature by way of the first coil. Embodiments of the invention also generally relate to a position switch which is implemented as a safety switch.

BACKGROUND

Devices to generate a magnetic force, such as are present in magnetic force drives of switches, are used, for instance, in association with position switches in both the industrial and the private field. They are used to make a danger area of a dangerous machine or production plant safe.

Position switches are also used in safety engineering, plant engineering, automation engineering and building services engineering. In this environment, for instance doors, flaps or other movable objects which are used for access or approach to parts of the machine or production plant must be made safe, meaning in detail that the relevant object is detected in the secure position and if appropriate locked in the secure position by a tumbler.

Position switches, particularly safety switches, are used for safe locking of protective doors, where for plant engineering or physical reasons opening the protective doors does not result in the dangerous potential being immediately switched off, but for instance, because of overrun of large drives, the dangerous potential remains until complete standstill. Such protective doors must be protected reliably against opening.

To lock and unlock the position switch, a tumbler is provided. The tumbler contains a device to generate a magnetic force. Depending on the version, the magnetic force or an elastic force can be provided to execute the locking movement. A position or safety switch with tumbler accordingly contains mostly elements which generate magnetic force and elastic force. The elastic force or elastic forces counteract the magnetic force, and depending on the type of locking either increasing or reducing the magnetic force results in locking the tumbler.

Such devices to generate a magnetic force, which are also called magnet systems or magnetic drives, must fulfill various conditions. To overcome the counterforce of the circuit element, as high a force budget as possible with as large a switching path as possible should be available. In this case a high force must be available, particularly in the end positions of the armature. Because the armature usually has two end positions and the coil force rises exponentially depending on the movement of the armature when the tumbler is switched on, at least one end position of the armature has a small magnetic force. This results in comparatively small forces at the start of the movement, and these affect the switching behavior of the tumbler disadvantageously. Additionally, as small as possible a design of the position or safety switch is wanted, as is a low power consumption.

In FIG. 1, the graphs G1 and G2 are shown. G1 shows the force of a switching unit depending on the switching path S.

G1 rises with the deflection S of the armature, which moves from the idle position into the locking position. Usually, in the process of actuating a circuit element a series of springs and elastic forces is involved, so that during the counterforce increase discontinuous changes occur.

It is problematical that the coil force precisely near the idle position of the armature is relatively small, mostly zero. G2 shows clearly that the coil force begins at the origin of the graph and would only be able to overcome the counterforce of the switching unit after a certain startup distance of the armature. In practice, in this case the result would not be a switching event, because the equilibrium of forces at the origin would be in favor of the counterforce. Until now, this has been got round by a short-term overcurrent to the coils which are included in the magnetic drive, so that a short-term magnetic force increase is generated to overcome the counterforce. This has a negative effect on the lifetime of the magnetic drive.

From EP 0 977 228 B1, a magnetic force drive with a high force budget on the basis of a short-term overcurrent is known. It is intended for use in a position switch.

SUMMARY

In at least one embodiment, the invention is based on the recognition that a high force budget can be implemented for the magnetic drive by means of coils of higher power (typically 5 to 8 Watt), in which case, however, not only the space requirement but also the self-heating of the magnetic drive is unnecessarily increased. Also, such a position switch is unsuitable for direct control by ASI, since the available current is limited.

In at least one embodiment, the invention is based on the recognition that a further alternative is magnetic drives with low space requirement, if the switching power or counterforce of the switching unit is small. However, this results in smaller switching paths, which in the case of such locks have a safety problem because of their high susceptibility to tolerance.

In at least one embodiment, a device is used to generate a magnetic force, the device managing with low power and low space requirement, a high force budget being available particularly in an end position of the armature. In the case of a position switch of the above-mentioned kind, the above may be achieved by at least one device for premagnetizing the armature.

The mode of operation of the device to generate a magnetic force of the stressed position switch is based on means of premagnetizing the armature. The armature can be magnetized by way of a first coil, which is also provided to move the armature. This magnetization is built up in interaction with the permanently counteracting elastic force, e.g. of a switching unit. According to at least one embodiment of the invention, before the armature is magnetized by the first coil, a premagnetization is generated in the armature, and makes the magnetic force, particularly at the first movement points of the armature, greater, in some cases significantly greater, than the counterforce. This premagnetization is possibly permanently present, or is established shortly before the magnetization by the first coil. Because of the presence of the premagnetization, therefore, a magnetic force is already present before the switching process is put in motion. Consequently, an additional magnetic force is available for the force budget.

In the case of an advantageous embodiment, the device for generating a magnetic force has a first device for premagnetization, which is a magnetizing element. Advantageously, this magnetizing element or even multiple magnetizing elements can be, for instance, distributed near the armature, or advantageously in the device to generate a magnetic force. Because of the placing, a desired magnetic force can be generated, a contact between the magnetizing element and the armature or an element of the armature being particularly advantageous for an optimum magnetic flux.

In the case of an advantageous embodiment, the magnetizing element is a permanent magnet and/or a second coil. Permanent magnet support to generate a magnetic force is advantageous because the permanent magnet has no power consumption, and consequently makes a higher magnetic force budget possible without short-term overcurrent, and with a lower space requirement. A second coil as a magnetizing element is useful if the amount of the magnetic force is to be adjustable depending on the position of the armature. It is also conceivable that the premagnetization which is caused by a second coil can be used to hold back the armature, and counteracts the magnetic force which the first coil generates. At the start of the locking process, the current feed to the second coil can be interrupted, so that a necessary imbalance of forces is generated.

In the case of an advantageous embodiment, the device has a first yoke as a further device of premagnetization, it being possible to premagnetize the armature via the first yoke. An advantage which is shown here is that the first yoke makes flexible positioning of the magnetizing element possible within the device. In this case, the first yoke conducts the magnetic flux from the magnetizing element to the armature. In relation to this, it is also advantageous that in some circumstances contacting of the three elements and thus maintenance of a comparatively high magnetic flux occur, so that the magnetic force can be kept high. Also, by the formation of the first yoke, optimum contacting of the armature or one of its elements with the first yoke can be supported. In particular, plane contacting is advantageous, because of optimum magnetic flux.

In the case of an advantageous embodiment, the magnetic holding force which is caused by the premagnetization changes discontinuously when a holding element of the armature or the armature itself is detached from the first yoke. The discontinuous change is achieved by a loss of contact between the holding element or armature and the first yoke, so that the magnetic flux is substantially reduced because of the resulting air gap.

In the case of an advantageous embodiment, the holding element is provided to conduct magnetic fluxes from the first yoke and a second yoke into the armature. The result is a switching effect if the second yoke can be magnetized by the first coil. In this case, the premagnetization of the armature, which was caused by way of the first yoke, turns into magnetization by the driving first coil in association with the second yoke into an oppositely directed magnetization. In this case, the armature or the holding element of the armature exchanges the contacting with the first or second yoke. A position of the holding element or armature between the first and second yoke turns out to be disadvantageous regarding energy, for which reason a position of this kind is automatically suppressed by a corresponding buildup of force difference. The holding element or armature preferably remains in contact with either the first or the second yoke. This ensures a very safe circuit.

Other advantageous versions and further developments of embodiments of the invention can be taken from the description of the figures and/or from the detailed description.

BRIEF DESCRIPTION OF THE DRAWINGS

Below, the invention is described and explained in more detail on the basis of the embodiments which are shown in the figures.

DETAILED DESCRIPTION OF THE EXAMPLE EMBODIMENTS

Figure 1:
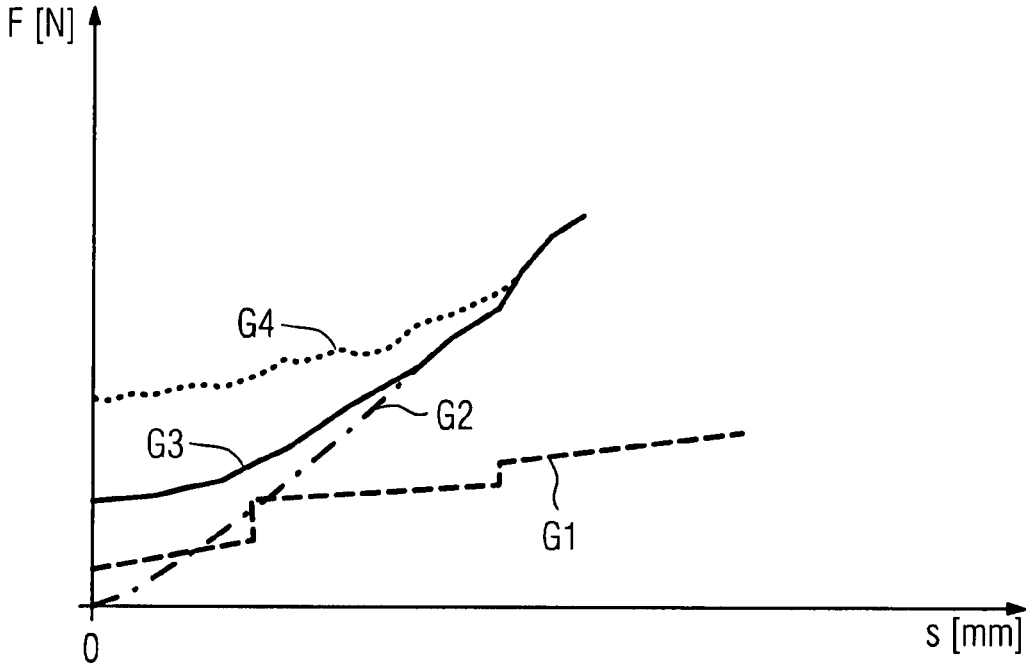
FIG. 1 shows example magnetic forces and an example counterforce of a device to generate a magnetic force depending on various armature positions.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

FIG. 1 shows example magnetic forces G2, G3, G4 and an example counterforce G1 of a device to generate a magnetic force depending on various armature positions S. As already described in the introduction, G1 represents the schematic course of the counterforce, as it is caused, for instance, by a switching unit of a position switch, safety switch or contactor. This counteracts the magnetic drive, and has two discontinuous increases of the counterforce G1. These are based on connection of new restoring forces, such as can be caused, for instance, by a multiplicity of springs in use. Since an elastic force is used as the counterforce, a counterforce G1 is already present in the idle position (S=0). In contrast, a magnetic force G2, which is opposite to the counterforce G1, normally develops from the origin and increases exponentially with the deflection of the armature. The magnetic force course of G2 cannot be used in association with the counterforce G1, because in the idle position the counterforce G1 exceeds the magnetic force G2. If so, a position change of the armature, e.g. locking or switching, does not take place.

However, by way of premagnetization according to an embodiment of the invention, as in the case of the magnetic forces G3, G4, it is possible to increase the magnetic force at position S=0 and adjacent positions substantially compared with the counterforce, and thus to avoid a disadvantageous overcurrent. The premagnetization can act in the opposite or same direction as the magnetization by the drive coils. If the premagnetization acts in the same direction, the total necessary magnetization does not have to be generated by the drive coils, so that a lower power consumption and/or less powerful coils can be used. If the premagnetization acts in the opposite direction, the result is a kind of restraining effect, which leaves the armature in its position until the premagnetization is cancelled out by the magnetization of the armature by the drive coils. In this case, the premagnetization and the associated magnetic attraction of the armature undertake a restraining function.

The magnetic force courses G3, G4 can be regulated by a suitable choice of the magnetizing element, e.g. permanent magnets or a second coil. If a permanent magnet is used, the behavior of G3 or G4 cannot be changed. In the case of continuous regulation of the magnetic force by way of a second coil, even magnetic force courses between G3 and G4 are continuously adjustable.

Figure 2:
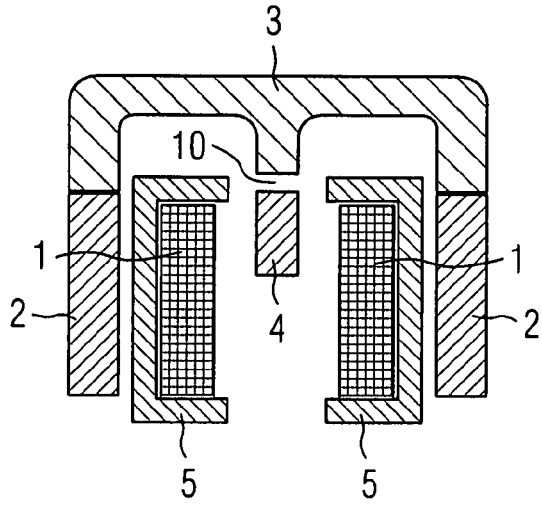
FIG. 2 shows a schematic representation of important parts of a first embodiment.

FIG. 2 shows a schematic representation of important parts of a first embodiment. The first coil 1, also called the drive coil, is provided to magnetize and move the armature 4. The armature 4 is in the idle position, and has an air gap 10 to the first yoke 3. The first yoke 3 is provided to conduct the magnetic flux which is to be conducted from the magnetic elements 2 into the armature 4. The air gap 10, which can be implemented, for instance, by a corresponding limit stop for the armature 4, is used to regulate the magnetic flux from the first yoke 3 onto the armature 4.

The transmission of the magnetic flux increases almost discontinuously with the approach of the armature 4 to a contact surface of the first yoke 3. If the premagnetization by the magnetizing elements 2 acts in the opposite direction to the magnetization of the first coil 1, the premagnetization is capable of fixing the armature 4 in the idle position. Only by activating the first coil 1, is the armature 4 moved in the direction of the center of the first coil 1. There the armature 4 reaches a switching position which can be implemented by a corresponding mechanical, if appropriate positive, join to the slide of a switching unit.

Advantageously, in the case of the first embodiment, restraining springs which act on the armature 4 can be partly or completely eliminated. Their function is taken over by a counterforce which results from the premagnetization. Advantageously, the magnetic force of the premagnetization changes discontinuously with the distance of the armature 4 from the first yoke 3. The result is the desired restraining effect.

Advantageously, at least a second yoke 5, which separates the magnetic flux of the first coil 1 from the magnetic flux of the magnetizing elements 2, is provided.

Advantageously, when the magnetizing elements 2, e.g. permanent magnets, are used, higher forces are present at the start of the movement. Additionally, when the coil is switched off, the reverse movement of the armature 4 into the idle position is supported by the magnetizing elements 2. With this permanent magnet support, it should be noted that a mechanical stress on the magnetizing elements 2 during the switching events remains low. When the armature 4 moves out of the idle position, the air gap 10 can be used for mechanical decoupling from the first yoke 3, so that the magnetizing elements 2 do not become involved. On the other hand, in the case of the return to the idle position, a mechanical stress can be avoided by the first yoke 3 being at least partly in semicircular or arc-shaped form, so that the mechanical flow of force is not conducted onto the magnetizing elements 2.

Even in the case of this first embodiment, a back pressure spring for the armature 4 can be designed to be weak or can be omitted completely. Coils with a lower power consumption, i.e. spatially smaller coils, can be used. This implies a space reduction which makes a small, narrow design of the position switch possible. Use of the smaller coils results in less heating of the position switch. Alternatively or optionally, it is possible to implement a larger number of poles because of the increased magnetic force at the start of the movement of the armature 4. Here it has a specially positive effect, that no electronic driving is required for the short-term overload, as was previously necessary, and thus a simple coil construction, which is also less expensive, can be used.

Figure 3:
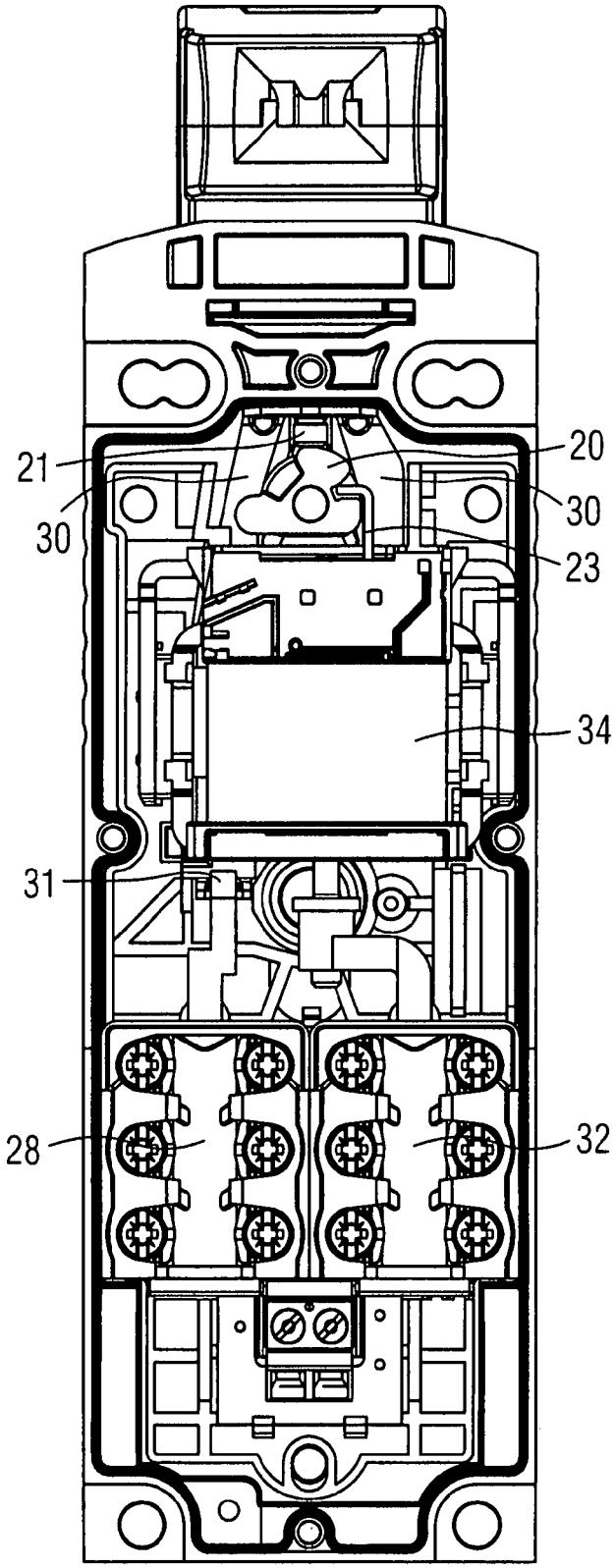
FIG. 3 shows a front view of a second embodiment of a position switch without a cover.

FIG. 3 shows a front view of a second embodiment of a position switch without a cover. The position switch is intended for use with a separate actuator (not shown). A component of the tumbler of the position switch is the second locking element 20, which is fixed in the position switch so that it can rotate. The second locking element 20 can be blocked by the tappet 21 in combination with the first locking element 22, which is in the form of a ratchet wheel, and can be moved by the magnetic drive 34 by way of an actuation metal sheet 23.

Additionally, the position switch has two switching units 28, 32, the left-hand switching unit 28 being connected by way of a further actuation metal sheet 30, which is connected on the one hand to the tappet 21 and to the left-hand switching unit 28 by way of the foot 31, which is formed onto the actuation metal sheet 30. The actuation metal sheet 30 is a plane, angled component, which is provided to bypass spatially, in particular, the magnetic drive 34.

The right-hand switching unit 32 is joined positively to the armature 24 of the magnetic drive 34. Thus the left-hand switching unit 28 is provided to detect the operating state of the position switch, since this can be positively triggered by the tappet 21 or by the separate actuator, where "positive" means that a force path is ensured because of the shapes of the components. Additionally, the right-hand switching unit 32 is in direct effective connection with the magnetic drive 34, so that it is also possible to establish whether a tumbler or locking by way of the tumbler is implemented or not. Consequently, the above-mentioned states can be interrogated by means of the corresponding circuits.

Figure 4:
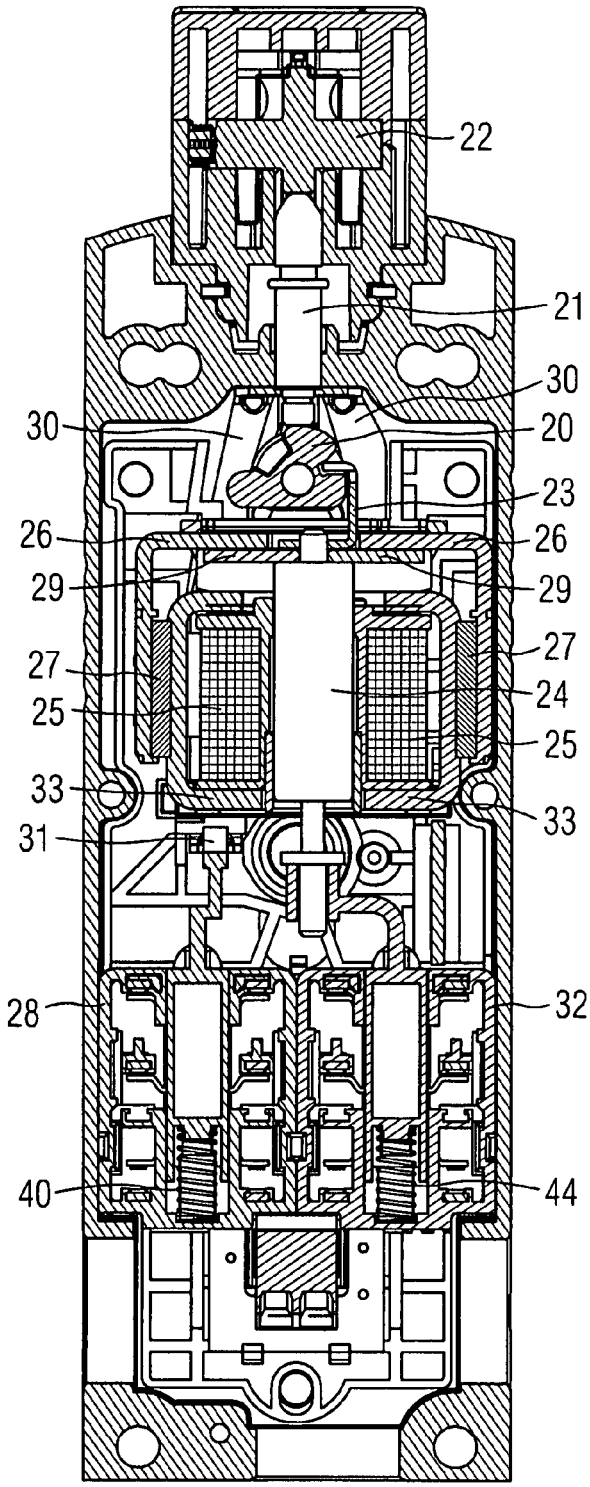
FIG. 4 shows a cut away front view of the second embodiment from FIG. 3.

FIG. 4 shows a cut away front view of the second embodiment from FIG. 3. The cut away view allows a view of the components of the magnetic drive 34, as it is called in FIG. 3.

The magnetic drive 34 has a first coil in the form of the coil 25, and an associated armature 34 with a holding element 29. The holding element 29 is in plane form, and is provided for mechanical contacting of the outer yoke 26 and inner yoke 33. The armature 24 is in the idle position if the holding element 29 is adjacent to the outer yoke 26, or in the locking position if the holding element 29 is adjacent to the inner yoke 33. Use of restraining springs is not necessarily required here, but they can be used for support. Because of the premagnetization by the permanent magnets 27, the holding element 29, together with the armature 24, is held in the idle position. In this case, an optimum magnetic flux from the permanent magnets 27, via the outer yoke 26, via the holding element 29, into the armature 4 takes place. Advantageously, the magnetic field of the permanent magnets 27 is additionally screened by the inner yoke 33, so that the outer yoke 26 is protected from magnetization by the coil 25.

Because of the plane design of the holding element 29, the magnetic flux between the holding element 29 and the outer yoke 26 can be regulated, i.e. the holding force in the idle position can be adjusted.

If the tumbler is activated, current is fed to the coil 25, so that magnetization is built up in the armature 24 in the opposite direction to the premagnetization of the permanent magnets 27. Detachment of the holding element 29 from the outer yoke 26 results in abrupt termination of the magnetic holding force, and thus to a substantial magnetic force difference immediately after the detachment. The consequence is the powerful changeover of the armature 24, together with the holding element 29, into the locking position, in which case the magnetic flux of the coil 25 is conducted via the inner yoke 33 through the holding element 29 into the armature 29. The increased magnetic force difference benefits the switching process, in which the right-hand switching unit 32 is securely actuated.

Advantageously, a position switch which provides a back pressure spring 40, 44 for the magnetic drive as support, in the case of a possible break of the back pressure spring 40, 44, is capable of maintaining the locking by the force of the permanent magnets until the first unlocking, provided that an elastic force locking system is involved.

The actuation areas 23, 30 are advantageously designed similarly to angle iron, i.e. plane with bending edges, so that it becomes possible for the mechanical component to avoid important parts of the position switch. Thus, in particular, the actuation metal sheet 30 avoids the centrally attached magnetic drive 34, to operate the left-hand switching unit 28 with its foot 31.

Figure 5:
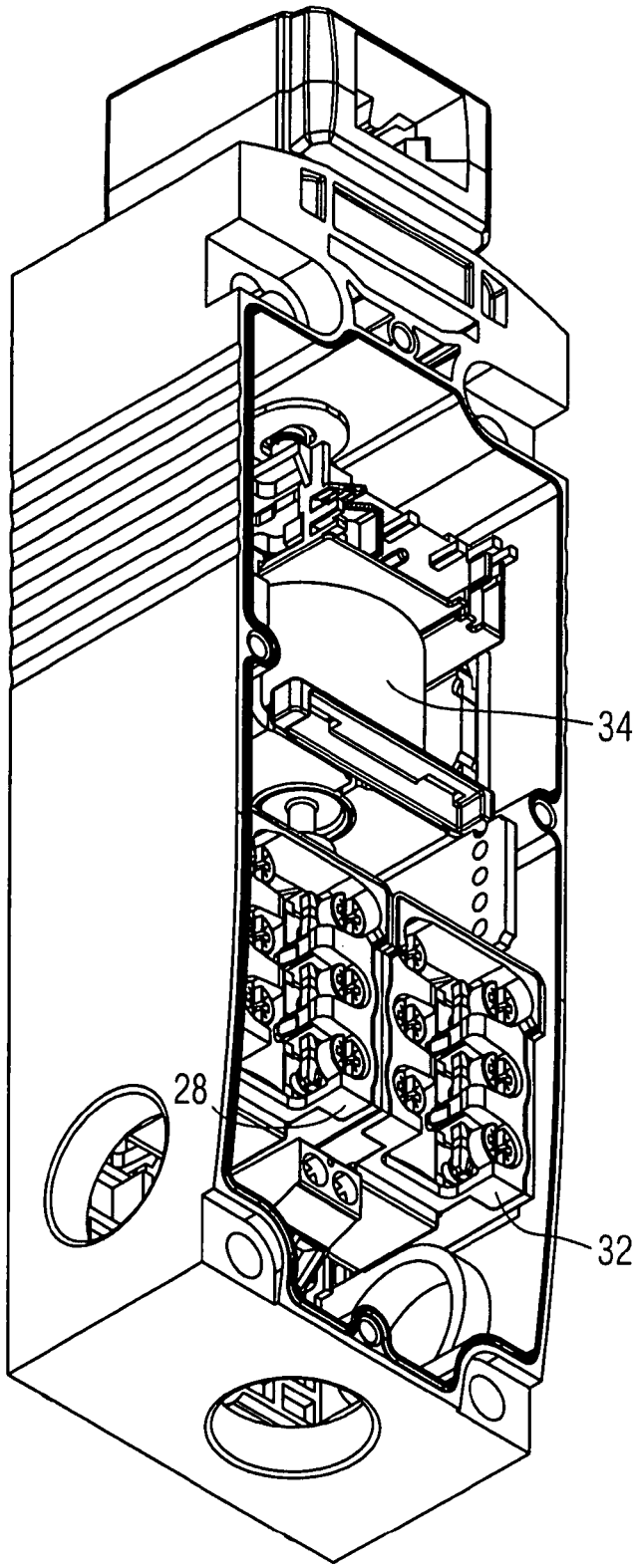
FIG. 5 shows a perspective view of the second embodiment from FIG. 3.

FIG. 5 shows a perspective view of the second embodiment from FIG. 3, in which particularly the left-hand 28 and right-hand switching unit 32 and the magnetic drive 34 appear more clearly.

In summary, at least one embodiment of the invention concerns a position switch with a device to generate a magnetic force for magnetic drives, with at least a first coil and at least one armature, it being possible to magnetize and move the armature by way of the first coil. How the magnetic force, particularly at the start of movement of the movable components of the device, can be increased to reduce the necessary power consumption of the first coil for this purpose, is taught. For this purpose, the device to generate a magnetic force has at least one device for premagnetizing the armature. The result is a series of advantages, e.g. a smaller design, lower power consumption and possible use with multiple different switching units with different counterforces.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A position switch, comprising:

at least one coil in the position switch;

at least one armature adjacent to the at least one coil, the at least one armature being magnetizeable and configured to move via the at least one first coil;

at least one actuator connected to the at least one armature;

a rotatable locking element fixed in the position switch and connected to the at least one actuator;

a locking device connected to the rotatable locking element via a connecting element;

at least one premagnetizing device configured to premagnetize the at least one armature; and at least two switching units housed within the position switch, the at least two switching units including a first switching unit configured to detect an operating state of the position switch and a second switching unit configured to establish a locking state of the rotatable locking element.

2. The position switch as claimed in claim 1, wherein the at least one premagnetizing device includes a magnetizing element.

3. The position switch as claimed in claim 2, wherein the magnetizing element includes at least one of a permanent magnet and another coil.

4. The position switch as claimed in claim 3, wherein the at least one armature is premagnetizeable via a first yoke as the at least one premagnetizing device.

5. The position switch as claimed in claim 4, wherein a magnetic flux is conductable by the first yoke from the magnetizing element into the at least one armature.

6. The position switch as claimed in claim 4, wherein a magnetic holding force is discontinuously changeable when at least one of a holding element of the at least one armature and the armature itself is detached from the first yoke.

7. The position switch as claimed in claim 6, wherein the holding element is configured to conduct magnetic fluxes from the first yoke and a second yoke into the at least one armature.

8. The position switch as claimed in claim 4, further including a holding element between the at least one armature and the first yoke, wherein the holding element is directly connected to the first yoke when the at least one coil is not charged.

9. The position switch as claimed in claim 1, wherein the premagnetization of the at least one armature is set against a magnetization of the armature by the at least one coil.

10. A safety switch, implemented as a position switch as claimed in claim 1.

11. The position switch as claimed in claim 1, wherein the at least one armature is premagnetizeable via a first yoke as the at least one device.

12. The position switch as claimed in claim 11, wherein a magnetic holding force is discontinuously changeable when at least one of a holding element of the at least one armature and the armature itself is detached from the first yoke.

13. The position switch as claimed in claim 12, wherein the holding element is configured to conduct magnetic fluxes from the first yoke and a second yoke into the at least one armature.

14. The position switch as claimed in claim 1, wherein the second switching unit is positively joined to the at least one armature and the first switching unit by-passes the at least one armature and is connected to the rotatable locking element via the connecting element.

15. A position switch, comprising:

at least one coil;

at least one armature, the at least one armature being magnetizeable and moveable via the at least one first coil;

at least two switching units housed within the position switch; and means for premagnetizing the at least one armature, wherein a first switching unit is connected to a rotatable locking element, and wherein a second switching unit is positively joined to the at least one armature and the first switching unit by-passes the at least one armature and is connected to the rotatable locking element via a connecting element.

16. The position switch as claimed in claim 15, wherein the means for premagnetizing includes a magnetizing element.

17. The position switch as claimed in claim 16, wherein the magnetizing element includes at least one of a permanent magnet and another coil.

18. The position switch as claimed in claim 17, wherein the at least one armature is premagnetizeable via a first yoke as the means for premagnetizing.

19. The position switch as claimed in claim 18, wherein a magnetic flux is conductable by the first yoke from the magnetizing element into the at least one armature.

20. The position switch as claimed in claim 18, wherein a magnetic holding force is discontinuously changeable when at least one of a holding element of the at least one armature and the armature itself is detached from the first yoke.

21. The position switch as claimed in claim 20, wherein the holding element is configured to conduct magnetic fluxes from the first yoke and a second yoke into the at least one armature.

22. The position switch as claimed in claim 15, wherein the premagnetization of the at least one armature is set against a magnetization of the armature by the at least one coil.

* * * * *